US005295687A

United States Patent [19]

Bedard

[11] Patent Number: 5,295,687

[45] Date of Patent: Mar. 22, 1994

[54] IMPACT WEAPON

[76] Inventor: Roy R. Bedard, 2711 Allen Rd., Apt. J5, Tallahassee, Fla. 32312

[21] Appl. No.: 993,673

[22] Filed: Dec. 21, 1992

[51] Int. Cl.[5] ..... F41B 15/00

[52] U.S. Cl. ..... 273/84 R

[58] Field of Search ..... 273/84 R, 84 ES; 30/312; D22/117, 118

[56] References Cited

U.S. PATENT DOCUMENTS 4,052,063 10/1977 Wong ..... 273/84 R
4,498,669 2/1985 Chun ..... 273/84 R
4,655,456 4/1987 Chen Dai ..... 273/84 R

*Primary Examiner*—Vincent Millin
*Assistant Examiner*—William M. Pierce
*Attorney, Agent, or Firm*—Arthur G. Yeager

[57] ABSTRACT

An impact weapon includes a long straight shaft and a handle with two forwardly angled arm members extending laterally therefrom. One arm member is slightly arcuate to facilitate the transfer of the weapon from the offensive position, wherein the weapon is grasped by the handle, to a defensive position wherein the weapon is grasped by the other arm member which is substantially straight thereby providing a "pistol-grip" like hold. The weapon is unitary in construction. The arm members and handle have flared striking heads to allow for pressure compliance techniques with a reduced risk of puncture wounds.

13 Claims, 3 Drawing Sheets

IMPACT WEAPON

BACKGROUND OF THE INVENTION

1. Field of the Invention

The present invention relates to impact weapons for use by law enforcement officials and particularly to nightsticks and riot batons and the like.

2. Prior Art

A wide variety of impact weapons such as clubs, riot batons, nightsticks and the like are known to the prior art. Many of these devices consist of a long rod-like element with a hand grip at one end such as a nightstick. A transverse handle may extend from the body in the proximity of the grip in a device known as a side handle baton. Both a straight nightstick and the side handle baton have advantages and disadvantages. Generally speaking, the straight stick is a superior striking tool and thus is principally an offensive weapon. The side handle baton on the other hand can be held in a manner to provide a blocking or defensive capability. However, even a skilled user cannot readily shift use of the weapon between offensive and defensive modes of operation. In addition, neither weapon is effective at close range where modern nerve pressure point pain compliance techniques can be used. Also, both weapons are rather large and cumbersome and thus are difficult to carry. The result is that some users may simply not carry the device. In an attempt to deal with the size and weight problem, some manufacturers have compromised by making batons that are hollow or collapsible. This approach simply results in a baton that is not adequate for use in the field.

Examples of the prior art include the police club of U.S. Pat. No. 3,944,226; the short impact weapon disclosed in U.S. Pat. No. 4,052,063, which provides for use in close combat but does not have offensive capability; an attempt to improve the handles on a side handle baton in U.S. Pat. Nos. 4,109,912; 4,132,409; 4,203,599; 4,667,958; and 4,703,932; the night stick in U.S. Pat. No. 4,283,051; the collapsible baton in U.S. Pat. No. 4,492,377; and finally, the complex assembly of U.S. Pat. No. 4,655,456 which provides a baton-like alternative embodiment but without providing a structure that allows for quick movement between offensive and defensive use.

What is desirable in an impact weapon is a device that provides for rapid conversion of the weapon from an offensive striking tool capable of delivering energy transfer to a chosen defensive tool that can be held against the arm to provide for a solid barrier between the user and an attacker. The device should also provide for effective use in close quarters at the very closest body position. Furthermore, the device should be of reduced size and be of unitary construction to eliminate the possibility of breakage. None of the prior art impact weapons provides for all the necessary requirements, being defective in one or more areas discussed above.

SUMMARY OF THE INVENTION

In one aspect of the present invention there is provided an impact weapon made from a unitary body including an elongated shaft having first and second opposite end portions and a longitudinal axis therebetween, a first elongate arm member having an end connected to and extending laterally from the shaft and a free end, the first arm member being located spaced remotely from the first end portion of the shaft to define the first end portion as substantially longer than the second end portion. The second end portion of the shaft is adapted to be gripped by a hand of a user to dispose the first end portion forwardly from a user. A second elongate arm member is connected to and extends laterally from the shaft and a free end, the second arm member being located on the shaft substantially opposite from the first member, each arm member being oriented with respect to the shaft such that the respective longitudinal axis of each the arm member defines an angle with the longitudinal axis of the shaft of less than ninety degrees, the ends of the first and second members are attached to the shaft rearwardly of the free end.

Other aspects of the present invention are seen to include a weapon in which one arm member is adapted for rotational movement of the weapon about a thumb of a user between offensive and defensive positions of the weapon. The second arm member is greater in length than the first arm member and the free end of each arm member is enlarged for use in striking an opponent. The second end portion has greater diameter than the diameter of the first end portion and is formed to fit a human hand to provide for use as a handle. The body further includes a flared element integral to and between the second arm member and the first end portion to adapt the second arm member for grasping by a human hand. The first arm member is formed to be arcuate in shape to facilitate rapid rotational movement of the weapon from an offensive position to a defensive position by a user.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
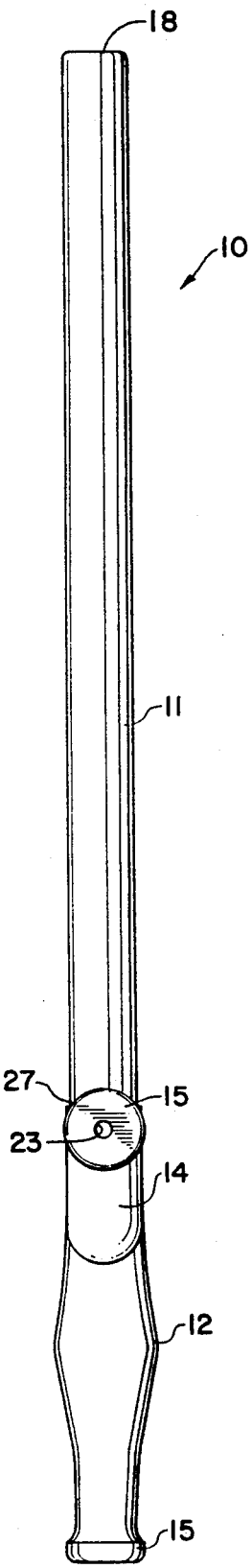
FIG. 1 illustrates a side elevational view of the impact weapon in accord with the present invention.
Figure 2:
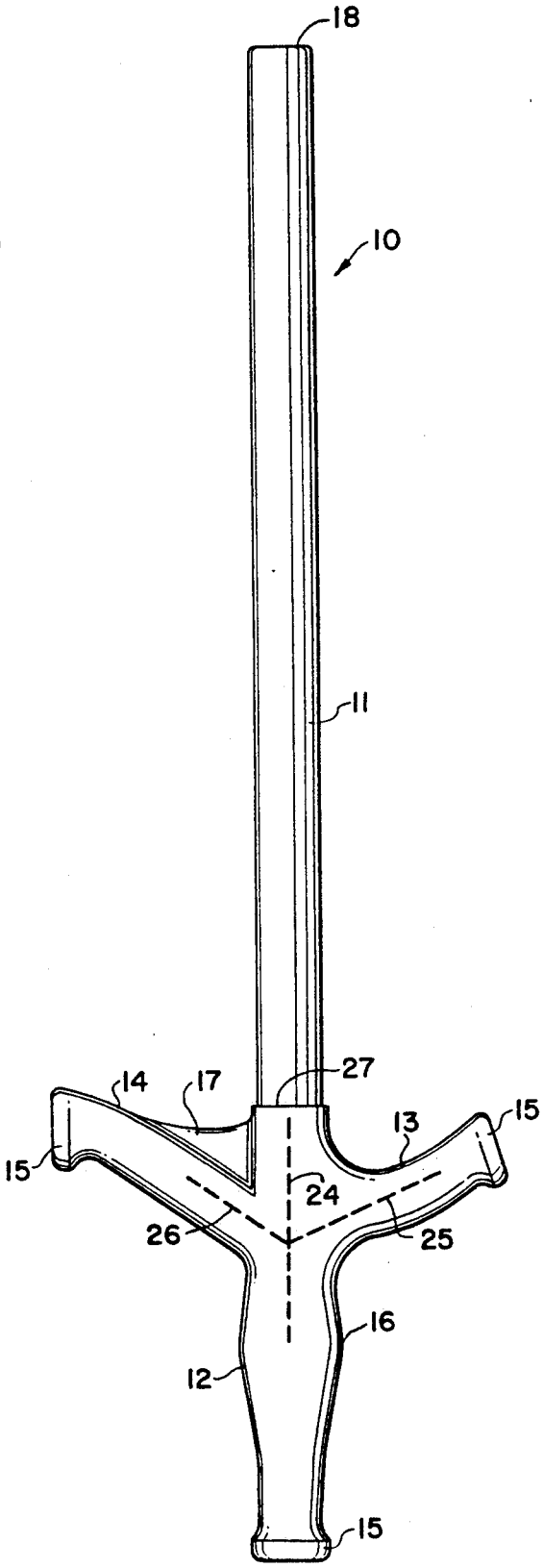
FIG. 2 is a front elevational view of the weapon of FIG. 1.
Figure 3:
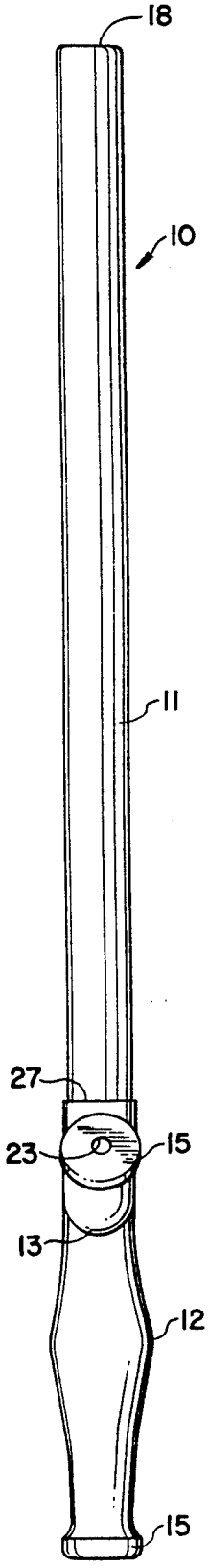
FIG. 3 is another side elevational view of the weapon of FIG. 1.
Figure 4:
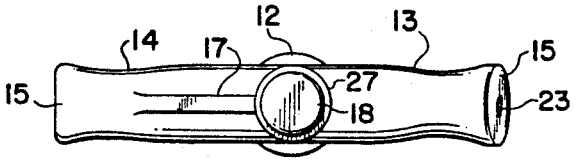
FIG. 4 is a top view of the weapon of FIG. 1.
Figure 5:
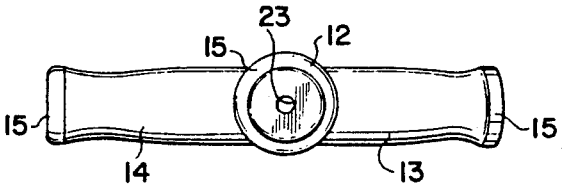
FIG. 5 is a bottom view of the weapon of FIG. 1.

Referring now to the drawings, the impact weapon in accord with the present invention is depicted at numeral 10 in FIGS. 1-3. In FIG. 2, all of the aspects of the impact weapon can be seen clearly. An elongated shaft or baton element 11 is connected to a shorter shaft or handle 12. A first arm member 13 extends laterally from the axis of the shafts 11 and 12 and is curved slightly to provide for a good grip by the user as will be described hereinbelow. A second arm member 14 is straight and positioned opposite first arm member 13 and extends at an angle from the axis of the shafts to provide for a "pistol-grip" shape as will be described. For providing a secure grip by the user in different modes, handle 12 has an enlarged diameter portion 16 which is positioned to be in the center of a user's hand in a first offensive position and a flared portion 17 is integral with second arm member 14 for a secure grip in a second defensive position. The handle 12, and each first and second arm member have slightly enlarged striking heads 15 on the free ends thereof that provide an impact surface that is blunt enough to prevent puncture wounds in use. The baton element 11 need not include a striking head for the reason that baton element 11 is generally not used for nerve pressure point operation.

Figure 6:
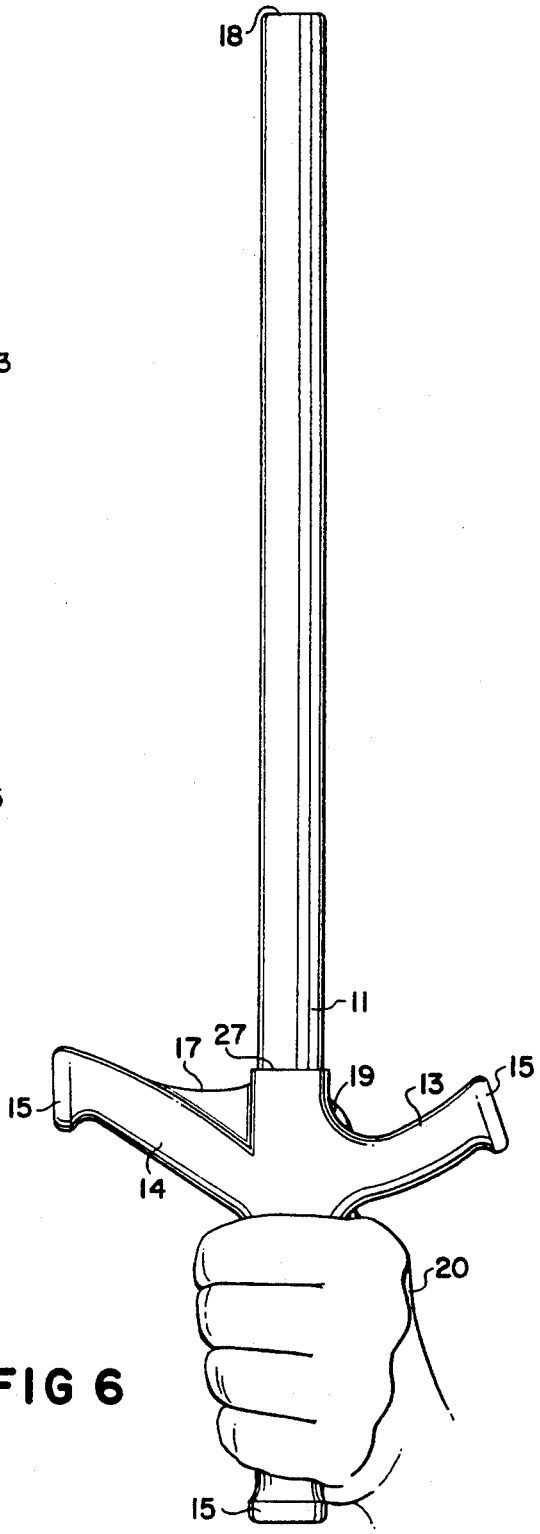
FIG. 6 illustrates the weapon of FIG. 1 being held in an offensive position.
Figure 7:
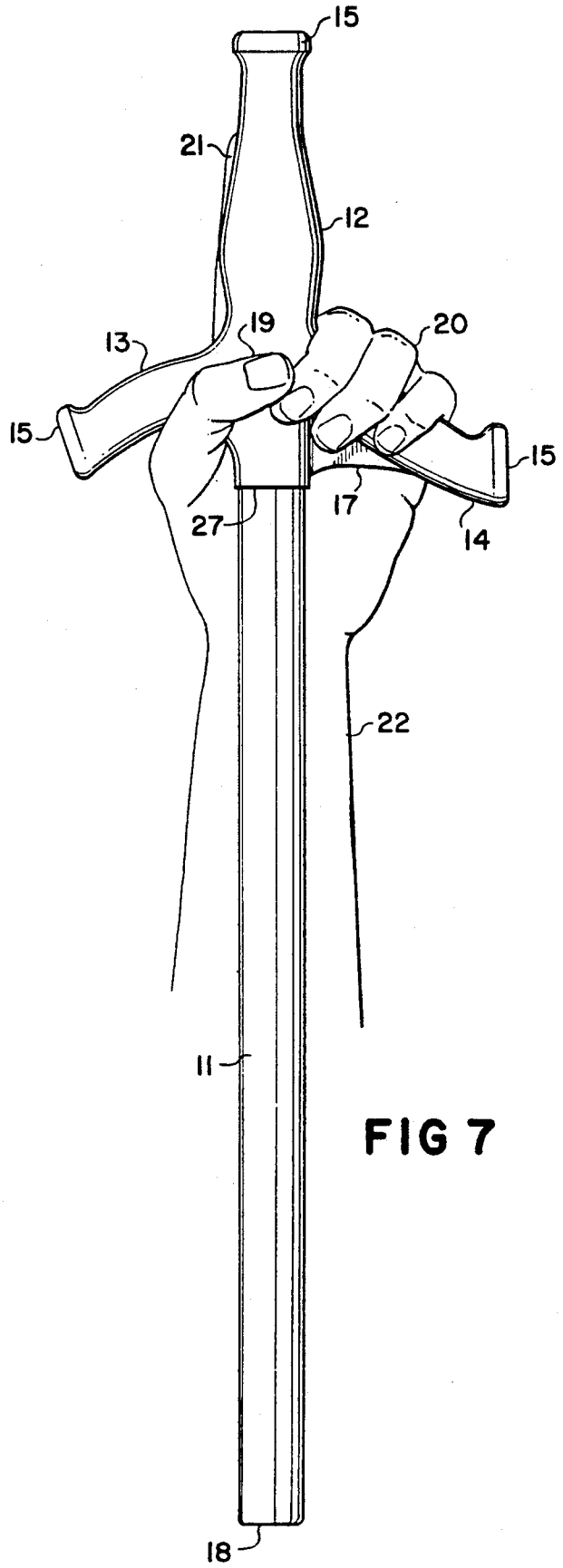
FIG. 7 illustrates the weapon of FIG. 1 being held in a defensive position.

FIG. 6 illustrates how the weapon 10 is held in the conventional club-like position for offensive purposes. The user's hand 20 grasps the handle 12 with the thumb 19 resting at the junction of baton element 11 and the first arm member 13. Movement of the weapon 10 from the offensive position of FIG. 6 to the defensive position of FIG. 7 is accomplished by holding the weapon 10 with the thumb 19. For example, when held in the left hand 20 as illustrated in FIG. 6, the weapon 10 is rotated inwardly and downwardly around first arm member 13 while being held with the thumb 19 and the fingers are moved to grasp second arm member 14 in a "pistol-grip" fashion with the index finger 21 extended on handle 12. The baton element 11 rests against the inner lower forearm 22 and is held there by pressure of the index finger 21 against the handle 12. The weapon 10 can then be used to provide offensive capability by forcing a striking head 15 against the body of an attacker. Importantly, greater force can be applied in this configuration than otherwise because the wrist is kept straight and thus the entire arm 22 is used to deliver a blow. Also, in this configuration, the weapon 10 can be used defensively to block blows by hand or by a weapon by simply rotating the arm to place baton 11 outwardly towards an opponent.

Openings 23 are provided in the striking heads as illustrated in FIGS. 1, 3, 4 and 5 for the mounting of inserts (not shown) that may be required by departmental regulations to further reduce the risk of serious injury from contact with a respective head 15.

The weapon 10 is preferably a unitary structure made of metal, wood, plastic, or hard rubber. In addition, various materials can be used on the weapon to improve its effectiveness. For example, many materials can be used on handle 12 to improve the grip of the user. It is also possible that a wood or plastic model of the weapon could be loaded with an iron bar to increase rigidity and improve the overall weight and balance of the device.

For purposes of structural description, axis lines are shown in FIG. 2. Axis 24 represents the longitudinal axis of the weapon 10 which can be described as an elongated shaft divided into two end portions, 11 and 12, by the position of the two arm members, 13 and 14, which have a respective longitudinal axis 25 and 26. As can be seen from the drawing, the angle between the axis lines 25 or 26 and the body axis line 24 is less than 90 degrees as each arm member 13 and 14 is angled forwardly when the weapon 10 is held in an offensive position. This arrangement also provides for protection of the user's hand 20 against a wide variety of weapons such as knives.

Flange surface 27 is illustrated to point out that the particular construction of the weapon 10 provides that the handle 12 is of greater diameter than the baton element 11. The illustrated preferred embodiment of weapon 10 includes structural details, such as flange 27, that derive from the manufacturing process. For example, shaft 11 is shown as a round rod. It is to be understood, however, that the baton element 11 could be square or any other shape as desired.

Arm member 14 is long enough to provide for a full finger grip if desired. The surfaces of handle 12 and arm members 13 and 14 are slightly curved and smooth to provide a comfortable grip by the user in either an offensive or defensive position of the weapon 10. The striking head 15 on arm member 13 is shown as not perpendicular to the head on arm member 14. This arrangement is optional and other arrangements are possible as desired in the circumstances.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An impact weapon comprising a unitary body including an elongated shaft having first and second opposite end portions and a longitudinal axis therebetween, a slightly curved first elongate arm member having an end connected to and extending laterally from said shaft and a free end and having a longitudinal axis therebetween, said first arm member being located spaced remotely from said first end portion of said shaft to define said first end portion and substantially longer than said second end portion, said second end portion being adapted to be gripped by a hand of a user to dispose said first end portion forwardly from a user, a straight second elongate arm member connected to and extending laterally from said shaft and a free end and having a longitudinal axis therebetween, said second arm member being located on said shaft substantially opposite from said first member, each said are member being oriented with respect to said shaft such that respective said longitudinal axis of each said arm member defines an angle with said longitudinal axis of said shaft of less than ninety degrees, said ends of said first and second members being rigidly attached to said shaft rearwardly of respective said free end with respect to said first portion when said first portion is positioned forwardly from a user.

2. The impact weapon as defined in claim 1 wherein said first arm member includes a curved shape for ready engagement with a thumb of a user for rotational movement of said weapon about a thumb of a user between offensive and defensive positions of said weapon.

3. The impact weapon as defined in claim 1 wherein said second arm member is greater in length than said first arm member.

4. The impact weapon as defined in claim 1 wherein each said arm member free end is enlarged with respect to a cross-sectional area of said arm member for use in striking an opponent.

5. The impact weapon as defined in claim 1 wherein said second end portion of said shaft includes an end enlarged with respect to a cross-sectional area of said shaft for use in striking an opponent.

6. The impact weapon as defined in claim 1 wherein each said arm member and said second end portion includes an end enlarged with respect to a cross-sectional area of said arm member for use in striking an opponent.

7. The impact weapon as defined in claim 1 wherein a cross-sectional area of said second member is greater than a cross-sectional area of said first end portion.

8. The impact weapon as defined in claim 1 wherein said second end portion is formed to fit a human hand to provide for use as a handle.

9. The impact weapon as defined in claim 1 wherein said body further includes a flared element integral to and between said second arm member and said first end portion to adapt said second arm member for grasping by a human hand.

10. The impact weapon as defined in claim 1 wherein said first arm member is formed to be arcuate in shape to facilitate rapid rotational movement of said weapon from an offensive position to a defensive position by a user.

11. An impact weapon comprising a unitary body including a handle portion and an elongate shaft portion extending therefrom, said handle portion including a short elongate second shaft adapted to be held to use said weapon in an offensive manner with said shaft portion forward of said handle portion and a first and second arm member, said first arm member extending laterally outwardly, said second arm member being substantially straight and extending laterally outwardly and adapted to be held in the hand of a user to use said weapon in a defensive position, with said shaft portion being held rearwardly of said handle portion, said arm members being located adjacent said handle to facilitate rapid movement of said weapon from said offensive position to said defensive position, said first arm member is formed to be arcuate in shape to facilitate rapid rotational movement of said weapon about the thumb of a user between said offensive and defensive positions.

12. The impact weapon as defined in claim 11 wherein said first arm member is formed to be arcuate in shape to facilitate rapid rotational movement of said weapon about the thumb of a user between said offensive and defensive positions.

13. The impact weapon as defined in claim 11 wherein each said arm member has a free end that is enlarged with respect to a cross-sectional area of said arm member for use in striking an opponent.

* * * * *